United States Patent [19]

Hazaki et al.

[11] Patent Number: 4,473,343

[45] Date of Patent: Sep. 25, 1984

[54] BEARING DEVICE FOR SCROLL-TYPE COMPRESSOR

[75] Inventors: Eiichi Hazaki, Ibaraki; Kenji Tojo, Shimizu; Naoshi Uchikawa, Shimizu; Akira Murayama, Shimizu, all of Japan

[73] Assignee: Hitachi, Ltd., Tokyo, Japan

[21] Appl. No.: 434,389

[22] Filed: Oct. 14, 1982

[30] Foreign Application Priority Data

Oct. 19, 1981 [JP] Japan ..... 56-165786

[51] Int. Cl.[3] ..... F04C 18/02; F04C 29/00; F04C 29/02

[52] U.S. Cl. ..... 418/55; 418/57; 418/88; 418/94; 418/151

[58] Field of Search ..... 418/55, 57, 88, 94, 418/151, 180

[56] References Cited

U.S. PATENT DOCUMENTS 4,065,279 12/1977 McCullough ..... 418/55

4,350,479 9/1982 Tojo et al. ..... 418/55

FOREIGN PATENT DOCUMENTS 55-160192 12/1980 Japan ..... 418/55

*Primary Examiner*—John J. Vrablik

*Attorney, Agent, or Firm*—Antonelli, Terry & Wands

[57] ABSTRACT

In a scroll-type compressor, the sum of pressure receiving areas of the upper end surfaces of crank portion of a crankshaft and the upper end surface of a balance weight is made substantially equal to the sum of the pressure receiving areas of the lower end surface of the shaft portion of the crankshaft and the lower end surface of the balance weight, the surfaces being subjected to internal pressures of the compressor. Consequently, only the downward force produced by the weights of the crankshaft and the rotor of a driving motor is applied to the crankshaft as an axial load which is born by a thrust bearing. Since the thrust bearing is required only to bear a small thrust load, it is free from the problems such as rapid wear and seizure.

4 Claims, 2 Drawing Figures

BEARING DEVICE FOR SCROLL-TYPE COMPRESSOR

BACKGROUND OF THE INVENTION

The present invention relates to a bearing device for scroll type compressor.

In, for example, U.S. Pat. No. 4,065,279, a scroll-type compressor is proposed which includes a wrap revolving scroll composed of an end plate and a wrap formed along an involute curve or a curve approximating an involute curve and standing upright from the end plate, and a stationary scroll having a construction similar to the revolving scroll but additionally provided with a discharge port. The revolving scroll and the stationary scroll are assembled together with their wraps mating with each other, and are housed by a housing having a suction port. An Oldham's ring prevents the revolving scroll from rotating around its own axis and is provided between the revolving scroll and the housing or between the revolving scroll and the stationary scroll. In operation, the revolving scroll is driven by a crankshaft to revolve in such a manner as not to make apparent rotation around its own axis, so that the volume of a chamber formed between two scrolls is continuously changed to cause a pumping action to displace a fluid in the chamber.

Another known type of scroll compressor incorporates a vertical crankshaft provided with a balance weight between the crank portion and the shaft portion of the crankshaft. In this scroll compressor, the crank portion of the crank shaft is received by a first bearing provided in the revolving scroll, while the shaft portions of the crankshaft are supported by two bearings, i.e. a second bearing and a third bearing, provided on the frame of the compressor. In addition, an intermediate chamber, accommodating the balance weight, is defined between the revolving scroll and the frame, and is maintained at a pressure intermediate between the discharge pressure and the suction pressure.

In this type of scroll compressor, the crank portion of the crankshaft has a diameter smaller than that of the shaft portion, in order to comply with a demand for reducing an impact which is generated in the eccentric crank portion at the time of start up of the compressor and the demand for reduction in size of the compressor as a whole. In operation, discharge gas pressure is applied to the upper end surface of the crank portion of the crankshaft and the lower end surface of the shaft portion of the crankshaft. Since the crank portion has a diameter smaller than that of the shaft portion the upward axial force applied to the crankshaft exceeds the downward axial force applied to the same. Consequently, a heavy load is applied to a thrust bearing which is formed as a unit with the first bearing and contacted by the upper end surface of the balance weight, often resulting in a rapid wear or, in the worst case, a seizure of the thrust bearing.

SUMMARY OF THE INVENTION

Accordingly, it is a primary object of the invention to provide an inproved bearing device for a scroll compressor which eliminates rapid wear and seizure of the thrust bearing attributable to a change in the internal pressure of the compressor.

It is another object of the invention to provide a bearing device for a scroll compressor in which only a downward force, generated by the weight of the crank shaft and the weight of rotor of the motor, is applied as an axial load on the crankshaft to the thrust bearing.

It is still another object of the invention to provide a bearing device for a scroll compressor which can eliminate the necessity for a thrust bearing for receiving an upward thrust load.

To these ends, according to the invention, there is provided a scroll-type compressor having a stationary scroll member, a revolving scroll member adapted to revolve with respect to the stationary scroll member, a crankshaft for revolving the revolving scroll member and including a crank portion, shaft portion and a balance weight therebetween. A first bearing is provided on the revolving scroll member and is adapted to support the crank portion of the crankshaft, with a second bearing and a third bearing supporting the shaft portion of the crankshaft. A thrust bearing is in contact with the balance weight and is adapted to receive the axial load applied to the crankshaft. An intermediate chamber is defined at the rear side of the revolving scroll member and accommodates the balance weight, with the pressure in the intermediate chamber being intermediate between the suction pressure and discharge pressure. An adjusting means is provided for adjusting an axial load applied to the crank shaft, with the adjusting means having an upper end surface of the crank portion and a lower end surface of the shaft portion subjected to the discharge pressure. The upper end surface and lower end surface of the balance weight which are subjected to the intermediate pressure, and the sum of the pressure receiving areas of the upper end surface of the crank portion and the upper end surface of the balance weight is substantially equal to the sum of the pressure receiving areas of the lower end portion of the shaft portion and the lower end surface of the balance weight, so that an axial force is applied to the crankshaft only in one axial direction.

These and other objects, features and advantages of the invention will become clear from the following description of the preferred embodiments taken in conjunction with the accompanying drawings.

DESCRIPTION OF THE PREFERRED EMBODIMENT

Figure 1:
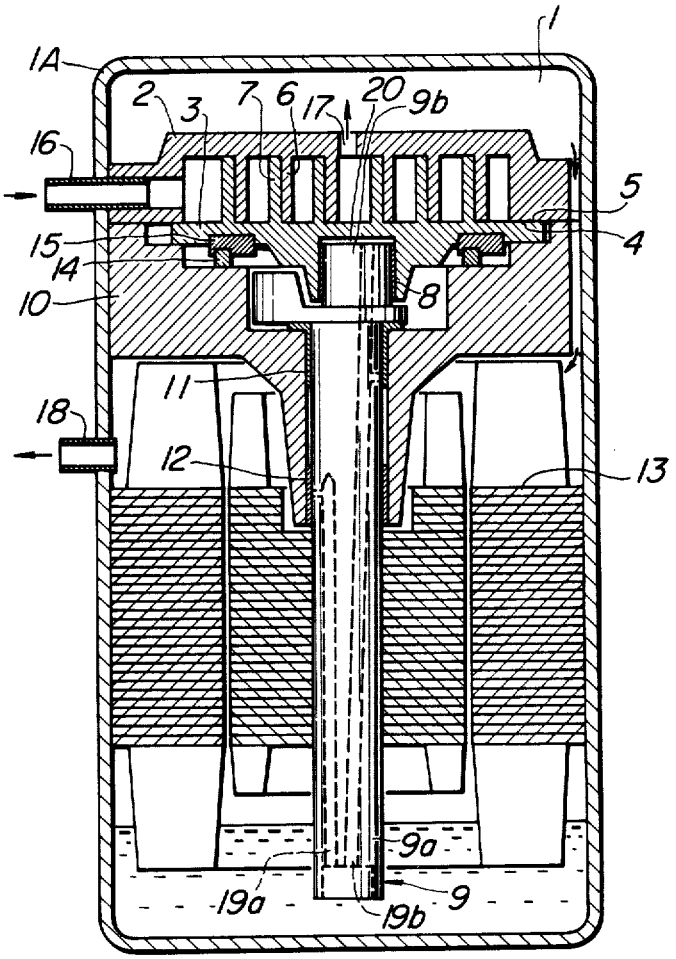
FIG. 1 is a vertical cross sectional view of a scroll compressor having a bearing device in accordance with an embodiment of the invention.

Referring to the drawings, and, more particularly, to FIG. 1, according to this figure, a scroll-type compressor has a housing 1A defining a chamber 1 for accommodating a stationary scroll 2 and a revolving scroll 3, with stationary scroll 2 including an end plate 4 and a wrap 6 in a spiral form standing upright from one surface of the end plate 4. The revolving scroll 3, also includes an end plate 5 and a spiral wrap 7 standing upright from one surface of the end plate 5, with the scrolls 2 and 3 being assembled together so that the wraps 6, 7 mate with each other. The revolving scroll 3 is provided on a lower side thereof with a first plain bearing 8 which is engaged by the crank portion **9*b* of a crankshaft 9, with the crank portion being formed at a predetermined eccentricity from the axis of the shaft portion 9a of the crank shaft 9**.

The shaft portion 9a of the crank shaft 9 is supported by an upper or second plain bearing 11 and a lower or third plain bearing 12 attached to the frame 10 of the compressor.

The crankshaft 9 is adapted to be driven by an electric motor 13 and, as the crankshaft 9 rotates, the revolving scroll 3 revolves while being prevented from making rotation around its own axis by the cooperation between an Oldham's ring 14 and the Oldham's key 15. As a result of the revolution of the revolving scroll 3, a gas, sucked through a suction pipe 16, is compressed between the revolving scroll 3 and the stationary scroll 2 and is forced into the chamber 1 through a discharge port 17 and then delivered to the outside of the compressor through the discharge pipe 18. As a result of the compression of the gas between the revolving scroll 3 and the stationary scroll 2, a load is imposed on the shaft portion 9a of the crankshaft 9 through the revolving scroll 3, first plain bearing 8 and the crank portion 9b of the crankshaft 9. This load is received by respective plain bearings 11 and 12. Two eccentric internal oil passages 19a and 19b are formed axially in the crankshaft 9. These oil passages are inclined with respect to the axis of shaft portion 9a such that the offset from the axis of the shaft portion is gradually increased towards the upper ends of these oil passages. Therefore, as the crank shaft 9 rotates, lubricating oil is sucked up from the oil pan defined at the bottom of the chamber 1 by the centrifugal pumping action and is delivered to the plain bearings 8, 11 and 12 to lubricate the latter.

Figure 2:
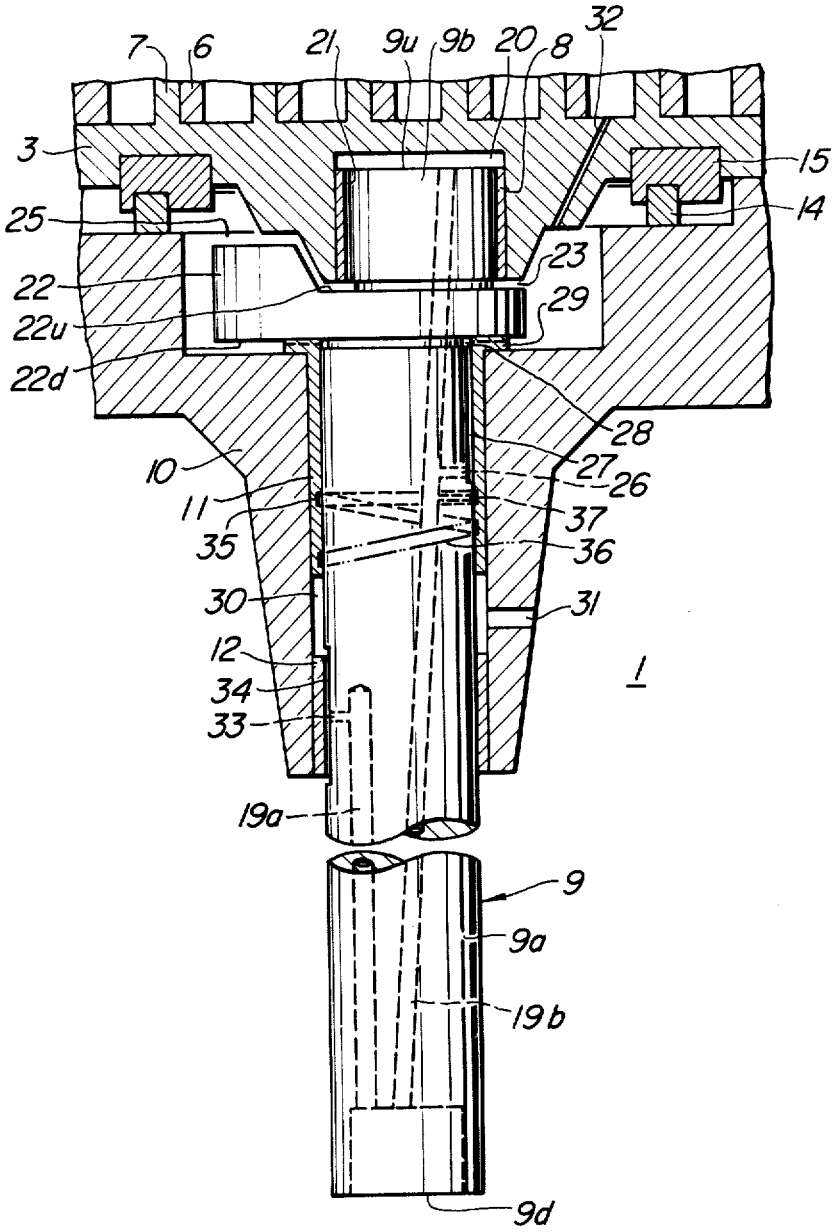
FIG. 2 is an enlarged vertical cross sectional view of a crankshaft portion of a scroll compressor incorporating a bearing device in accordance with an embodiment of the invention.

To supply lubricating oil to the plain bearing 8 of the revolving scroll 3, as shown most clearly in FIG. 2 the lubricating oil is sucked up from the bottom of the chamber 1 by the centrifugal pumping action of the eccentric oil passage 19b, and is introduced into a chamber 20 which is defined by the upper end of the crank portion 9b of the crankshaft 9, plain bearing 8 and the revolving scroll 3. The lubricating oil introduced into the chamber 20 is then supplied through an axial oil groove 21 formed in the outer peripheral surface of the crank portion 9b to the plain bearing 8 of the revolving scroll 3 to thereby lubricate the bearing 8 and the crank portion 9b. The oil which has lubricated the plain bearing 8 is discharged into an intermediate chamber 25 defined by the frame 10 and the revolving scroll 3, through an annular groove 23 formed in a juncture between the crank portion 9b and the balance weight 22 of the crankshaft 9.

As also shown in FIG. 2, to supply the lubricating oil to the second plain bearing 11 supporting the shaft portion 9a of the crankshaft 9, the lubricating oil is drawn through the eccentric oil passage 19b and then fed through an oil feed port 26 communicating with the eccentric oil passage 19b and through an axial oil feed groove 27 communicating with the oil feed port 26 and formed in the outer peripheral surface of the shaft portion 9a. The lubricating oil after lubricating the second plain bearing 11 is then introduced through an annular groove 28 formed in a juncture between the shaft portion 9b and the balance weight 22 into a thrust bearing 29 which is formed integrally with the second plain bearing 11 at the upper side of the latter, and is then discharged into the aforementioned intermediate chamber 25. A part of the lubricating oil which has lubricated the second plain bearing 11 is discharged from the lower end thereof into an oil discharge chamber 30 defined by the shaft portion 9a, frame 10, second plain bearing 11 and the third plain bearing 12, and is then discharged into the chamber 1 through an oil discharge port 31 formed in the frame 10.

The oil discharged into the intermediate chamber 25 is then introduced to the meshing part of both scrolls 2, 3 through a small hole 32 formed in the revolving scroll 3. Consequently, the pressure in the intermediate chamber 25 is maintained at a level intermediate between the discharge pressure and the suction pressure. Therefore, the supply of the lubricating oil to the second plain bearing 11 and the plain bearing 8 of the revolving scroll 3 is achieved by the sum of the pressure differential between the discharge pressure and the intermediate pressure and the pressure produced by the centrifugal pumping action of the eccentric oil passage 19b. The supply of lubricating oil to the third plain bearing 12 supporting the shaft portion 9a of the crankshaft 9 is achieved, as shown in FIG. 2, by sucking the lubricating oil through the eccentric oil passage 19a and then supplying the same into an oil feed port 33 communicating with the eccentric oil passage 19a and an axial oil feed groove 34 formed in the outer peripheral surface of the shaft portion 9a. A part of the lubricating oil after lubricating the third plain bearing 12 is discharged into the chamber 1 from the upper end of the third plain bearing 12 through an oil discharge chamber 30 and an oil discharge port 31, while the other part of oil is discharged directly into the chamber 1 from the lower end of the third plain bearing 12. The axial oil feed grooves 21, 27 and 34, as well as the oil feed ports 26 and 33, are positioned at offset from one another with respect to the direction of a load of the fluid pressure which acts in the radial direction of the crank shaft 9. More specifically, the oil feed groove 21 is formed at a position 90° ahead of the direction of load produced by the fluid pressure, as viewed in the direction of rotation of the crankshaft 9. The oil feed groove 27 is disposed at 180° offset from the oil feed groove 21 and the oil feed groove 34 is provided at 180° offset from the oil feed groove 27.

An annular groove 35 and a spiral groove 36 communicating with the annular groove 35 are provided in the side of the second plain bearing 11 opposite to the intermediate chamber 25. The annular groove 35 is communicated with the eccentric oil passage 19b through an oil feed passage 37. The spiral groove 36 is communicated at its one end with the annular groove 35 and is extended downwardly and spirally in the direction of rotation of the crankshaft 9 so as to terminate in the closed end. The annular groove 35 and the spiral groove 36 serve to prevent the gas in the chamber 1 under the discharge pressure from flowing into the intermediate chamber 25 through the plain bearing 11.

According to the invention, the pressure receiving area on the crankshaft 9 for receiving the downward pressure to produce downward axial force and the pressure receiving area on the same for receiving upward pressure to produce upward axial force are selected to be substantially equal to each other, for the reasons set forth hereinbelow.

In operation, as shown in FIG. 2, the shaft portion 9a and the crank portion 9b of the crank 9 have an equal diameter. Therefore, the area $A_1$ of the lower end surface 9d of the shaft portion 9a and the area $A_2$ of the upper end surface 9u of the crank portion 9b, both end surfaces 9d and 9u subjected commonly to the discharge pressure residing in the chamber 1, are equal to each other. Similarly, the area $A_3$ of the lower surface 22*d* of the balance weight 22 and the area $A_4$ of the upper surface thereof, these surfaces 22*d* and 22*u* subjected commonly to the pressure intermediate between the suction pressure and the discharge pressure, are equal to each other. Thus, the opposing axial forces exerted on the crankshaft 9 by the fluid pressures are balanced by each other even if the discharge pressure fluctuates, so that only the downward axial force $W_c$ produced by the weight of the crank shaft 9 and the weight of the rotor of the electric motor is applied to the crankshaft 9 as the downward axial load. The downward axial load $W_c$ is borne by the thrust bearing 29 formed on the second plain bearing 11. It will be understood that, in the bearing device of the invention, the thrust bearing 29 is free from the problem of rapid wear and seizure, because the downward axial force $W_c$ produced by the weights of the crank shaft 9 and the rotor of the motor is sufficiently small. Furthermore, according to the invention, it is not necessary to provide a thrust bearing on the lower face of the first plain bearing 8 of the crank portion 9*b*, because the axial load is imposed on the crankshaft 9 only in a downward direction.

As will be fully realized from the foregoing description, since only a small axial load, produced by the weights of the crankshaft and the rotor of the electric motor, is imposed on the crankshaft, the thrust bearing is required only to bear a small downward axial load so that the seizure and rapid wear of the thrust bearing are advantageously.

Although the invention has been described through specific terms, it is to be noted here that the described embodiment is not exclusive and various changes and modifications may be imparted thereto, for example, the invention can be applied to a scroll-type compressor having a ball-and-roller type bearing as the second bearing, without departing from the scope of the invention which is limited solely by the appended claims.

What is claimed is:

1. A scroll-type compressor comprising a stationary scroll member, a revolving scroll member adapted to revolve with respect to said stationary scroll member, a crankshaft means for revolving said revolving scroll member and including a crank portion, shaft portion and balance weight therebetween, a first bearing means provided on said revolving scroll member for supporting said crank portion of said crankshaft means, a second bearing means and third bearing means for supporting said shaft portion of said crankshaft means, a thrust bearing means in contact with said balance weight for receiving an axial load applied to said crankshaft means, an intermediate chamber means defined at a rear side of said revolving scroll member and accommodating said balance weight, means for supplying a pressure to said intermediate chamber means intermediate a suction pressure and a discharge pressure of the compressor, an adjusting means for adjusting an axial load applied to said crankshaft means, said adjusting means including an upper end surface of said crank portion and a lower end surface of said shaft portion, and an upper end surface and a lower end surface of said balance weight, means for subjecting said upper end surface of said crank portion and said lower end surface of said shaft portion to said discharge pressure, means for subjecting said uper end surface and lower end surface of said balance weight to said intermediate pressure, the sum of pressure receiving areas of said upper end surface of said crank portion and said upper end surface of said balance weight is substantially equal to the sum of pressure receiving areas of said lower end surface of said shaft portion and the lower end surface of said balance weight, so that an axial force due to at least a weight of the crankshaft means and a rotor means of a compressor drive motor is applied to said crankshaft means only in one axial direction, and wherein said upper end surface of said crank portion and said lower end surface of said shaft portion have an equal pressure receiving area.

2. A scroll-type compressor comprising a stationary scroll member, a revolving scroll member adapted to revolve with respect to said stationary scroll member, a crankshaft means for revolving said revolving scroll member and including a crank portion, a shaft portion and a balance weight therebetween, a first bearing means provided on said revolving scroll member for supporting said crank portion of said crankshaft means, a second bearing means and third bearing means for supporting said shaft portion of said crankshaft means, a thrust bearing means in contact with said balance weight for receiving an axial load applied to said crankshaft means, an intermediate chamber means defined at a rear side of said revolving scroll member and accommodating said balance weight, means for supplying a pressure in said intermediate chamber means intermediate a suction pressure and discharge pressure of the compressor, an adjusting means for adjusting an axial load applied to said crankshaft means, said adjusting means including an upper end surface of said crank portion and a lower end surface of said shaft portion, and an upper end surface and a lower end surface of said balance weight, means for subjecting said upper end surface of said crank portion and said lower end surface of said shaft portion to said discharge pressure, means for subjecting said upper end surface and said lower end surface of said balance weight to said intermediate pressure, the sum of pressure receiving areas of said upper end surface of said crank portion and said upper end surface of said balance weight is substantially equal to the sum of pressure receiving areas of said lower end surface of said shaft portion and the lower end surface of said balance weight, so that an axial force due to at least a weight of the crankshaft means and a rotor means of a compressor drive motor is applied to the crankshaft means only in one axial direction, and wherein said upper end surface and said lower end surface of said balance weight have an equal pressure receiving area.

3. A scroll-type compressor according to any one of claims 1 or 2, wherein said thrust means is provided on an upper end of said second bearing so as to be held in contact with the lower end surface of said balance weight.

4. A scroll-type compressor according to claim 3, further comprising a closed housing means for accommodating the components of said scroll-type compressor.

* * * * *